US009305451B2

(12) United States Patent
Liu et al.

(10) Patent No.: US 9,305,451 B2
(45) Date of Patent: Apr. 5, 2016

(54) SEISMIC ALARM AND WARNING SYSTEM

(71) Applicants: Yuxiang Liu, Palo Alto, CA (US); Sichen Liu, Palo Alto, CA (US)

(72) Inventors: Yuxiang Liu, Palo Alto, CA (US); Sichen Liu, Palo Alto, CA (US)

( * ) Notice: Subject to any disclaimer, the term of this patent is extended or adjusted under 35 U.S.C. 154(b) by 309 days.

(21) Appl. No.: 13/732,209

(22) Filed: Dec. 31, 2012

(65) Prior Publication Data

US 2014/0187142 A1 Jul. 3, 2014

(51) Int. Cl.
*G08B 21/00* (2006.01)
*G08B 21/10* (2006.01)

(52) U.S. Cl.
CPC ..... *G08B 21/10* (2013.01)

(58) Field of Classification Search
CPC ..... A61B 2562/0219; A61B 5/0809; A61B 5/7239; A61B 5/7257; A61B 5/0816; A61B 5/0402; A61B 5/113; A61B 5/14551; A61B 5/0488; A61B 5/11; A61B 5/0205; A61B 5/1038; A61B 3/113; A61B 5/0031
USPC ..... 340/690, 601, 686.1, 446, 471, 539.1, 340/539.22, 545.3, 545.4, 571, 572.7
See application file for complete search history.

(56) References Cited

U.S. PATENT DOCUMENTS

| | | | | |
|---|---|---|---|---|
| 4,300,135 | A * | 11/1981 | Korn et al. | 340/690 |
| 4,403,208 | A * | 9/1983 | Hodgson et al. | 340/902 |
| 5,929,767 | A * | 7/1999 | Wallick | 340/690 |
| 6,118,386 | A | 9/2000 | Yousif | |
| 6,216,985 | B1 * | 4/2001 | Stephens | 246/120 |
| 6,859,831 | B1 * | 2/2005 | Gelvin et al. | 709/224 |
| 7,375,646 | B1 * | 5/2008 | Diaz-Lopez | 340/690 |
| 7,515,041 | B2 | 4/2009 | Eisold et al. | |
| 2006/0022819 | A1 * | 2/2006 | Vincent Granny et al. | 340/539.17 |

* cited by examiner

*Primary Examiner* — Daniel Previl
(74) *Attorney, Agent, or Firm* — MU Patents; Timothy Marc Shropshire

(57) ABSTRACT

An improved seismic alarm system designed to alarm users of an upcoming seismic event and other natural disasters, and aid victims' survival after an earthquake. The seismic alarm system includes an accelerometer, a controller, an acoustic-to-electric transducer for acoustic pattern detection, and RF module to receive emergency radio signals. The alarm system has central controlling unit that sets off an alarm after processing signals from several module and components: accelerometer detects seismic P wave acceleration changes for early earthquake detection; acoustic-to-electric transducer detects human acoustics or predetermined acoustic patterns, then initiates an alarm that brings rescue attention to survivors; RF module is tuned to receive emergency radio signals.

12 Claims, 2 Drawing Sheets

SEISMIC ALARM AND WARNING SYSTEM

INVENTION BACKGROUND

Prior Art

Earthquakes are the results when the energy stored in the strain between two Earth's tectonic plates is suddenly released. The primary waves (P-waves) and secondary waves (S waves) are two main waves that are released during a seismic event. P waves are compression waves that radiate in all directions from the epicenter, while S waves are transverse waves, where the magnitude is dependent on the incident angle of the wave and geological factors. Even though both waves are generated simultaneously, P waves travel faster and reach the crust surface before the bigger, more destructive S waves. Thus, P waves are often the target in seismic event predictions by many seismic predicting devices and systems.

Accelerometers have been used to detect seismic activities in research since the 1940's. Most modern seismic detectors use accelerometers to detect seismic accelerations. In Chien-An Chen's U.S. Pat. No. 6,265,979, patent teaches an earthquake sensing device that takes in consideration of both vertical and horizontal waves produced by the seismic event, reducing false detection. Though the detection method has minimized false detections, the disclosed device lacks functions to aid the users after the earthquake.

Marvin J Yousif's U.S. Pat. No. 6,118,386 teaches a modular mountable device that detects earthquake magnitude 3.25 or above on the Rictor-scale. It has an integral superheterodyne-AM/radio preset to a certain local news-station, allowing ongoing notification of any earthquake rescue procedures after a timed audible-alarm sequence. Though the said disclosed device has the capability to help users after earthquakes, it lacks the capability to directly impact the survival of trapped earthquake victims and rescue efforts.

Many home earthquake alarms on the current market do their jobs appropriately, detecting a seismic event's P waves and alarming the users of an upcoming earthquake, but they lack the capability to help users for the entirety of an earthquake, from alerting users of an upcoming earthquake to helping post-event survivors.

INVENTION SUMMARY

In accordance with one embodiment, seismic alarm and warning system has an accelerometer to detect upcoming seismic events, an acoustic-to-electric transducer to pick up on-site acoustics, and a RF module to receive emergency radio signals. All said components are connected to a controller unit that determines appropriate actions for different scenarios.

Advantages

Accordingly several advantages of one or more aspects are as follows: to provide a seismic alarm system that is capable of helping the users before and during an earthquake, and also the victims after an earthquake. Other advantages of one or more aspects are that the seismic alarm is capable of warning users of natural disaster events (i.e. nearby earthquakes, tsunamis, hurricanes), thus offering a more complete solution for many scenarios. These and other advantages of one or more aspects will become apparent from a consideration of the ensuing description and accompanying drawings.

DRAWINGS

Brief Descriptions

DETAILED DESCRIPTION OF THE INVENTION

In one embodiment, a seismic alarm and warning system is capable of activating alarms, providing illumination, detecting particular acoustics, processing RF signals, and performing other control functions. The internal accelerometer monitors device position state, and detects P waves in order to predict the arrival of S waves, determining the occurrence of seismic event; upon the determination of a seismic event and an earthquake, which is a detectable seismic event that may cause damage, a microcontroller (MCU) will activate an alarm and a light module to notify the users visually and audibly, and to illuminate the surrounding. Upon the determination of an upcoming earthquake, and the changing of device position state, the said MCU will activate an acoustic-to-electric transducer (microphone) to pick surrounding sounds. If human sounds or particular sound patterns are detected, the device will record then broadcast the acoustics of interest with a preset audio message. This way increases the possibility that trapped victims will be noticed by rescue personnel. Preferably, the device is housed by a high integrity enclosure that minimizes the damage to the device during an earthquake. When earthquake is not detected, the device monitors acceleration changes and incoming radio frequency (RF) emergency signals, broadcasted by trusted organizations. Please note that the arrangement of components and the quantity of each component are subjected to change without compromising the essence of the invention. For example, instead of having one acoustic-to-electric transducer, it is possible for an embodiment to have a plurality of acoustic-to-electric transducers to operate as a microphone array. Embodiments and methods of operations are described further below with reference to the figures.

Figure 1:
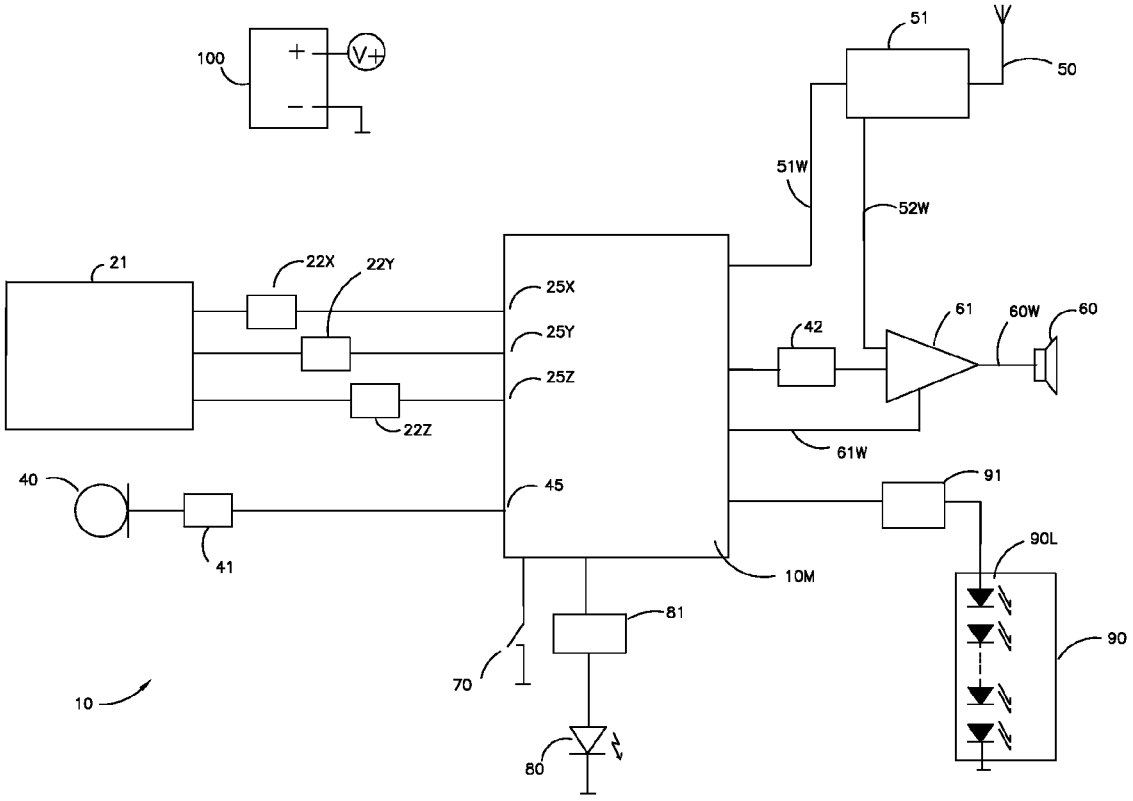
FIG. 1 is a functional block diagram of the device in accordance with one embodiment.

FIG. 1 illustrates a functional block diagram of one embodiment of the device. This embodiment of the device 10 comprises at least the following components: a 3-axis (X, Y, and Z) accelerometer 21 with three channel outputs, one output per axis; a controller unit in form of a microcontroller (MCU) 10M; a RF module 51 composed of at least a tuner, a demodulator, and an analog output; an electric-to-acoustic transducer 60 (i.e. a speaker); an acoustic-to-electric transducer 40 (i.e. microphone); light module 90 containing plurality of LED 90L; and a power supply 100.

Accelerometer 21 is a 3-axis sensor that detects acceleration changes on X axis, Y axis, and Z axis; each axis has its corresponding channel output. The accelerometer 21 detects and converts acceleration changes caused by seismic P waves on the X, Y, and Z axes into corresponding analog signals, which are then sent through X, Y, and Z channel outputs. Analog signals from the X, Y, and Z channel outputs are directed to designated operational-amplifier (OP-AMP) 22X, 22Y, and 22Z, respectively, for signal pre-amplifications. For example, acceleration changes on the X axis will induce electrical signal output from accelerometer 21 to OP-AMP 22X for signal pre-amplification; acceleration changes on the Y axis and Z axis go through the same process. The pre-amplified analog signal outputs from OP-AMPs (22X, 22Y, and 22Z) are directed to three Analog-to-Digital (A/D) inputs (25X, 25Y, and 25Z, respectively) on MCU 10M. The MCU 10M converts the incoming analog signal to digital data, and the said MCU also processes the digital data to determine if a set threshold is crossed, thus determining presence of an earthquake. If earthquake is determined, MCU 10M enables other components such as amplifier 61 and driver 91. The MCU 10M enables amplifier 61 through wire 61W. Said MCU then sends signals through Digital-to-Analog (D/A) converter 42, amplifier 61, then wire 60W to electric-to-acoustic transducer 60, creating sounds to alarm users. Driver 91 drives light module 90 to illuminate the surroundings.

Microphone 40 detects surrounding acoustics then outputs analog signal to OP-AMP 41 for analog signal amplification. Amplified signal will then be sent to A/D converter input 45. The MCU 10M determines if the said amplified analog signal is processed and analyzed when certain conditions are fulfilled: magnitude of determined earthquake crosses a threshold, and/or a determined change of post-earthquake device position state, determined when accelerometer post-earthquake position state change crosses a predetermined threshold. Upon fulfillment of the said conditions, the MCU 10M will allow A/D converter input 45 to accept amplified analog signal from 41; the analog signal will be A/D converted, processed through an algorithm, then analyzed for particular acoustic patterns and/or characteristics such as that of human voices. The A/D converter input 45 is enabled on specific schedule for a particular time interval. For example, upon sensing the device is tilted, MCU 10M could enable A/D converter input 45 after the determination of an upcoming earthquake, and could continue to enable the said A/D converter every other minute for a particular duration of time. Upon the recognition of particular acoustics characteristics and/or patterns, MCU 10M performs two actions: 1) initiates the recording of the acoustics for a length of time then store the data in the flash memory of MCU 10M: 2) enables amplifier 61, and retrieves the voice data and the said recording data from flash memory; the said data are then sent to D/A converter 42 for digital-to-analog conversion; the converted analog signal is then sent through amplifier 61 to electric-to-acoustic transducer 60 for broadcasting. For example, the device's broadcasting of digital voice and recording data retrieved from the flash memory might eventually sound "help!" followed by the recording of actual survivors' voices, "we are trapped here!" It is preferred that MCU 10M performs acoustics pickups and recording broadcastings in alternating sequence.

Antenna 50 is connected to RF module 51 which serves as a RF receiver. RF protocols from incoming signals are sent through wire 51W to MCU 10M where they are processed to determine the level of urgency the protocols carry (i.e. county vs. national emergency). If the urgency level crosses a specific threshold, then MCU 10M enables amplifier 61 through wire 61W, and the RF signals are processed, demodulated, then converted to analog signal in RF module 51 and sent to amplifier 61 for amplification through wire 52W. The amplified analog signal is then sent to electric-to-acoustic transducer 60 for broadcasting. RF is not used only for seismic emergencies but also for other emergencies at various levels of organization (i.e. national, state, county etc.) and importance (i.e. code red, code orange etc.).

Light module 90 is driven by driver 91. MCU 10M sends scheduled electric signal patterns to driver 91 upon the determination of an upcoming seismic event. For example, upon determining an earthquake, light module 90 flashes with set patterns for visual warning, and after several seconds, it will be continuously activated for illumination purposes.

When self-check button 70 is activated, preferably held down between 3 to 10 seconds MCU 10 will emulate scenario where there is an upcoming seismic event to see if all the described components are working properly together. The beginning, the ending, and the error occurrences will be coupled with auditory messages during the self-check test. For example, "Begin testing" and "test complete" can be used to notify the user the start and the finish of the test. If self-check button 70 is held down more than the preferred time mentioned previously, the button will perform a reset on the device back to its default settings.

Power supply 100 is preferably a long lasting battery. When power supply 100 is low on power, MCU 10M sends an electric signal to driver 81 to activate LED 80.

Figure 2:
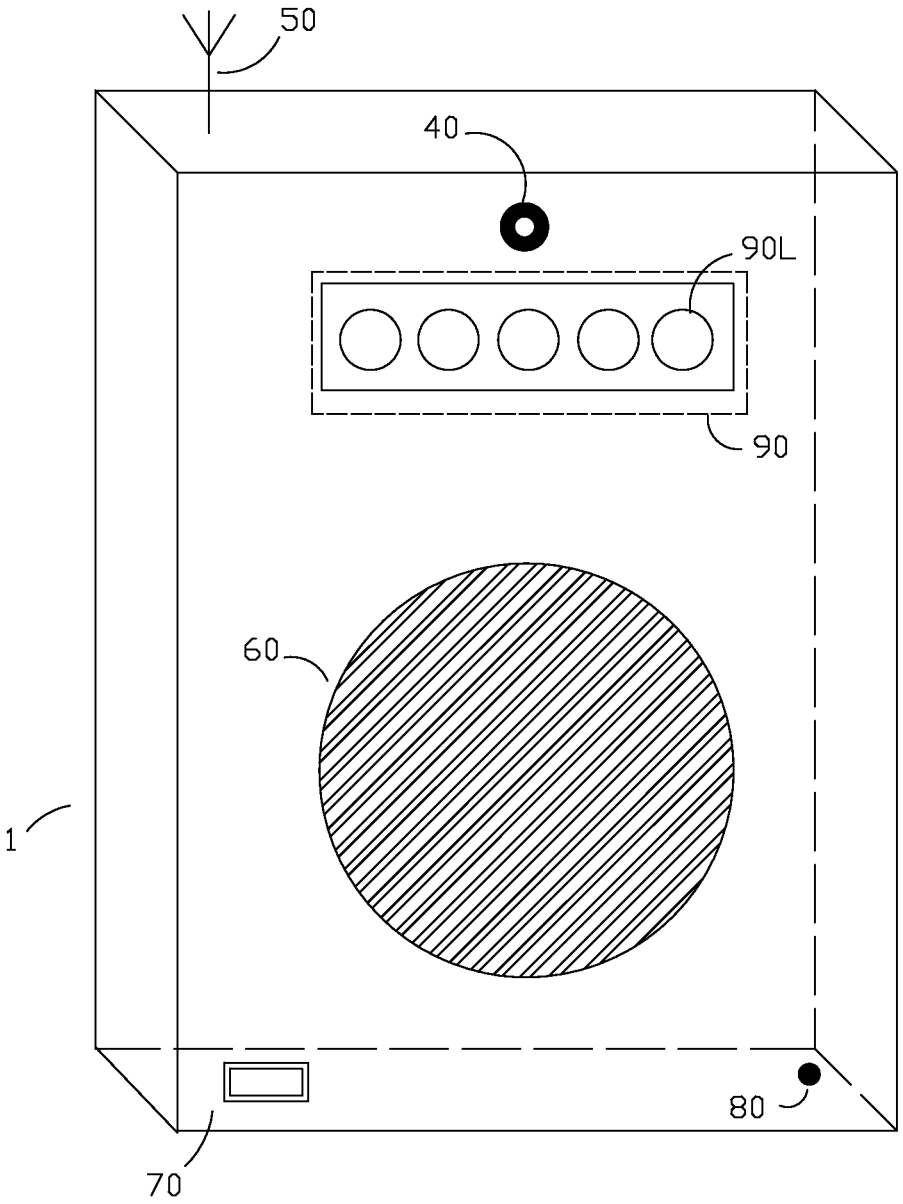
FIG. 2 is a perspective-view, favoring the frontal-side of the device.

FIG. 2 is a front-view illustration of the system with outer housing 1 containing the entirety of an embodiment of the device. The outer housing 1 preferably has high structural integrity to survive through an earthquake. Button placements and shape of outer housing 1 are not limited but can be changed for better aesthetics, device performance, and structure integrity. Placement of the device is not limited to vertical surfaces but also is capable of mounting onto horizontal and slanted surfaces.

We claim:

1. A seismic alarm and warning system comprising:

a. a 3-axis accelerometer;

b. at least one microphone;

c. at least one radio frequency module;

d. an electric-to-acoustic transducer; and e. a controller operationally coupled with the 3-axis accelerometer, the at least one microphone, and the at least one radio frequency module, wherein the controller is configured to monitor signals from the 3-axis accelerometer to determine the presence of a seismic event, to enable the at least one microphone, and to monitor signals from the radio frequency module for emergency broadcastings, wherein enabling of the at least one microphone depends on the signals from the 3-axis accelerometer, wherein the microphone records surrounding acoustics and is enabled by the controller to pick up surrounding acoustics at a predetermined time interval and to reproduce the acoustics through the electric-to-acoustic transducer.

2. The seismic alarm and warning system of claim 1, wherein said controller analog-to-digital converts then processes the signals from the 3-axis accelerometer to determine the presence of the seismic event, upon crossing a predetermined threshold value.

3. The seismic alarm and warning system of claim 1, wherein said controller enables the at least one microphone upon the determination of an earthquake, or a position state change of the 3-axis accelerometer, or both the determination of earthquake and a position state change of the 3-axis accelerometer.

4. The system of claim 3, wherein said controller analog-to-digital converts then processes and analyzes the incoming signals from the at least one microphone.

5. The seismic alarm and warning system of claim 4, wherein said controller enables the electric-to-acoustic transducer at a predetermined time interval to broadcast both an audio message stored in onboard memory and the recording of picked up surrounding acoustics in alternating sequence.

6. The seismic alarm and warning system of claim 1, wherein said controller controls the radio frequency module that receives emergency radio signals from the government, or trusted organizations, or both the government agencies and trusted organizations.

7. The seismic alarm and warning system of claim 6, wherein said controller processes information in the radio frequency signal thereby determining to broadcast the audio messages stored in onboard memory or the original message decoded from the radio frequency signal.

8. The seismic alarm and warning system of claim 1, further comprising a light to illuminate the surroundings and flash set patterns for a visual warning.

9. The seismic alarm and warning system of claim 1, wherein the 3-axis accelerometer detects acceleration changes of 3 axes, each axis being orthogonal to one another.

10. A method of operating a seismic alarm device and warning system comprising the steps of:

providing the seismic alarm device and warning system comprising:

a 3-axis accelerometer;

at least one microphone;

at least one radio frequency module; and a controller operationally coupled with the 3-axis accelerometer;

monitoring changes in acceleration and device position using the 3-axis accelerometer;

activating an audible alarm upon the determination of an earthquake using the 3-axis accelerometer;

activating the at least one microphone upon the determination of an earthquake using the 3-axis accelerometer;

detecting surrounding acoustics using the at least one microphone;

recording the detected acoustics using the device;

broadcasting the recording; and broadcasting audio emergency messages upon the receiving of an emergency radio frequency signal by the at least one radio frequency module.

11. The method of claim 10, wherein the emergency messages and the recording are broadcast in alternating sequence.

12. The method of claim 10, wherein the recording surrounding acoustics commences when the accelerometer detects a positional change of the device.

* * * * *